United States Patent [19]

Stager

[11] 4,156,215

[45] May 22, 1979

[54] COAXIAL MICROWAVE ATTENUATOR HAVING CONICAL RADIAL LINE ABSORBING MEMBERS

[75] Inventor: Christian Stager, Koeniz, Switzerland

[73] Assignee: Radiall, Rosny Sous Bois, France

[21] Appl. No.: 779,793

[22] Filed: Mar. 21, 1977

[30] Foreign Application Priority Data

Mar. 25, 1976 [CH] Switzerland ..... 3709/76

[51] Int. Cl.[2] ..... H01P 1/22

[52] U.S. Cl. ..... 333/81 A; 333/22 R

[58] Field of Search ..... 333/22 R, 81 R, 81 A

[56] References Cited

U.S. PATENT DOCUMENTS

| | | | |
|---|---|---|---|
| 2,968,774 | 1/1961 | Rodriguez | 333/81 A |
| 3,564,464 | 2/1971 | Hancock et al. | 333/81 A |
| 3,806,841 | 4/1974 | Brunner | 333/81 R |

*Primary Examiner*—Paul L. Gensler

*Attorney, Agent, or Firm*—Brisebois & Kruger

[57] ABSTRACT

Coaxial microwave attenuator for use at high power, which is independent of the frequency being transmitted. The attenuator comprises a series of conical absorption members assembled to obtain the desired attenuation.

6 Claims, 9 Drawing Figures

COAXIAL MICROWAVE ATTENUATOR HAVING CONICAL RADIAL LINE ABSORBING MEMBERS

BACKGROUND OF THE INVENTION

This invention relates to a coaxial microwave attenuator for high power, which operates independently of the frequency and in particular one having a fixed or adjustable structure. Such attenuators are frequently used in high frequency and microwave techniques.

In wave guide systems there is a clear tendency to increase the powers transmitted. Coaxial components such as attenuators or terminal resistors adapted to frequencies of more than 4 gigahertz and to powers greater than 10 watts are difficult to find on the market.

Fixed attenuators of a conventional type for frequencies ranging up to 18 gigahertz will only carry loads of a few watts. Such units are often grouped in the form of large cylindrical adjustable attenuators. If it is desired to obtain a graduation corresponding to variations of 1 decibel such attenuators are expensive. The coaxial or flat resistors of conventional attenuators are for the most part mounted on the inner conductor. This results in an undesirable transfer of heat to the more massive parts of the external conductor of the attenuator, which explains its low maximum load. If attenuators having directional couplers are used, it is possible to increase the maximum load by placing at the end of the direct line of the coupler a resistance having a high loading capacity. When the line is coupled one may, however, accommodate a minimum attenuation of about 10 decibels, which is often not very desirable.

In French Pat. No. 70.06639, an attenuator is proposed in which most of the aforesaid deficiencies are avoided. In order to obtain over a large band (for example 10:1 and more) an attenuation curve which is independent of the frequencies, one is also obliged, in this solution, to combine various individual absorption members assembled in series, one after the other, into a complete attenuator.

The present invention has the object of providing individual absorption members which are identical to each other, function independently of the frequency, and which may be assembled in series one after the other to obtain the desired degree of attenuation.

Such an attenuator is made, like the one in French Pat. No. 70.06639, by mounting in series a certain number of individual potentiometers. In order to explain the new principle of the attenuator operating independently of the frequency a single coaxial line connected in series will first be described.

In the following explanation, FIGS. 1–5 represent the prior art.

Figure 1:
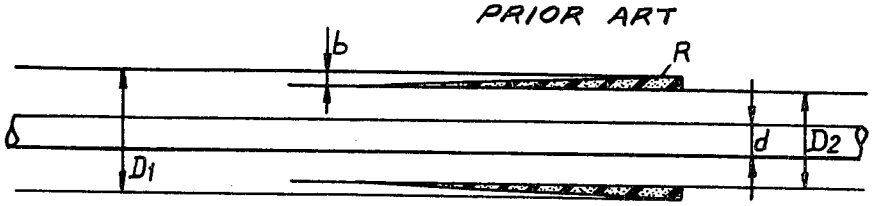
Fig:1 PRIOR ART
FIG. 1 is a schematic view in section of a prior art coaxial microwave attenuator.
Figure 2:
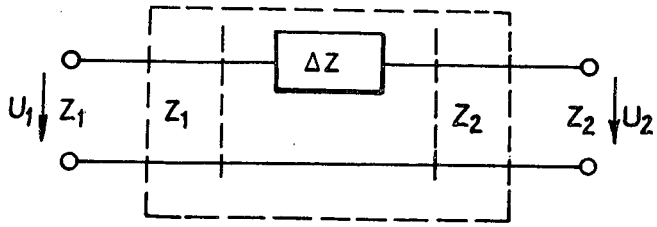
Fig:2 PRIOR ART
FIG. 2 is a block diagram of characteristic impedances of the attenuator of FIG. 1.
Figure 3:
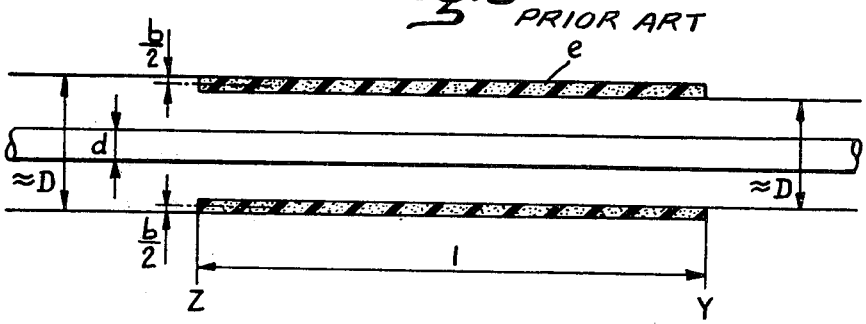
Fig:3 PRIOR ART
FIG. 3 shows another form of prior art attenuator.

FIG. 1 shows a line of this type becoming a voltage divider when the element of the coaxial line of low impedance constituted by the external conductor 10 having a diameter $D_1$ and an inner conductor 12 having a diameter $D_2$ is provided with a non-reflective terminal resistance R, and when the element of the coaxial line constituted by conductors 12 and 14 and having the diameters $D_2$ and d respectively, is terminated in its characteristic impedance. The characteristic impedances may be determined from FIG. 2 as follows:

$$Z_1=(138/\sqrt{\epsilon_r})\ \mathrm{Log}\ (D_1/d)\ [\Omega]$$

$$Z_2=(138/\sqrt{\epsilon_r})\ \mathrm{Log}\ (D_2/d)\ [\Omega]$$

$$\Delta Z=(138/\sqrt{\epsilon_r})\ \mathrm{Log}\ (D_1/(D_1-2b))\ [\Omega]$$

for $b<<D_1, D_{\frac{1}{2}}$ is $\approx D$, and therefore $Z_1 \approx Z_2 \approx Z$ The transitional attenuation of the voltage divider may be evaluated from the partial voltages in accordance with FIG. 2:

$$U_2=U_1Z/(Z+\Delta Z)$$

$$P_2=U_2^2/Z=(U_1Z/(Z+\Delta Z))^2/Z=(U_1^2\cdot Z)/(Z+\Delta Z)^2$$

$$P_1=U_1^2/(Z+\Delta Z)$$

$$(P_1/P_2)=(U_1^2/(Z+\Delta Z))\cdot((Z+\Delta Z)^2/(U_1^2\cdot Z))=(Z+\Delta Z)/Z$$

$$A[dB]=10\ \mathrm{Log}\ (P_1/P_2)=10\ \mathrm{Log}\ (Z+\Delta Z)/Z$$

This attenuation is independent of the frequency because it is a function only of the geometric masses of the voltage divider. If the elongated hollow annulus between conductors 10 and 12 is filled with a dielectric e subject to losses, up to the surface of the inner wall of the outer conductor, as shown on FIG. 3, the impedance $\Delta Z\sqrt{\epsilon_r}$ evaluated from FIGS. 1 and 2 depends only on the relative dielectric coefficient $\bar{\epsilon}_r$ and the coefficient of permeability $\bar{\mu}_r$ of the dielectric, when the length of the annulus l from the end y of the short-circuited annulus is so large that for the lower limit of the selected frequency $f_\mu$no appreciable reaction is produced at the beginning Z of the annulus. It follows that:

$$\Delta Z\sqrt{\epsilon_r}\approx 138\cdot K\cdot\log\ (D+2\cdot b/2)/(D-2\cdot b/2)[\omega]$$

from which:

$$K\approx=\sqrt{(\mu_r/\epsilon_r)}=,\ Z\ \mathrm{coax}=138\ \log\ (D/d)[\omega]$$

$\bar{\epsilon}_r$ and $\bar{\mu}_r$ are magnitudes which depend generally on the frequency. Measurements made on various compositions of materials have made it possible to attain a favorable dielectric mixture comprising three parts, one of which is non-magnetic, another of which is magnetic and another part which is made of a moldable resin for instance an epoxy resin with a heat polymerizing catalyst. The coefficient $K=\sqrt{(\mu_r/\epsilon_r)}$ of this mixture is to a large extent independent of the frequency. The attenuation during transit is then:

$$A_{[dB]}=10\ \log\ (Z+\Delta Z\epsilon)/Z\approx 10\ \log\ (1+K\cdot(\log\ (D+b)-\log\ (D-b))/(\log\ D-\log\ d))$$

that is to say, the attenuation is above the lower limit of frequency $f_\mu$, independent of the constant of frequency and depends only on geometry and K.

Figure 4:
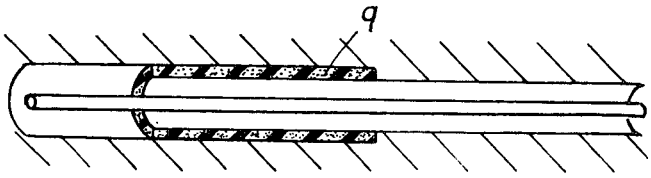
Fig:4 PRIOR ART
FIG. 4 shows another form of prior art attenuator.

Practical attenuators cannot be made as shown in FIG. 4 because, by reason of the length necessary for the member q, an attenuator comprising several members would be much too long.

Figure 5:
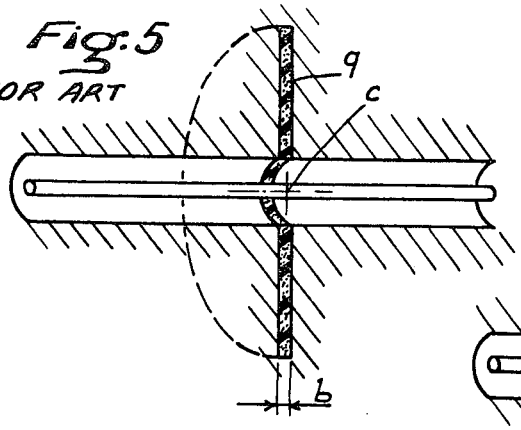
Fig. 5 PRIOR ART
FIG. 5 shows a prior art disc attenuator.

The member q can be mounted only perpendicularly to the direction of the line as shown in FIG. 5. Thus q forms a radial line subject to losses with a spacing b between conductors. The radial lines having a constant spacing between conductors are not homogenous, that is to say their characteristic impedance decreases as one moves away from the center C.

This is also why the condition for holding the partial impedance $\Delta Z\sqrt{\epsilon_r}$ constant independently of the attenuation frequency is not fulfilled.

Figure 6:
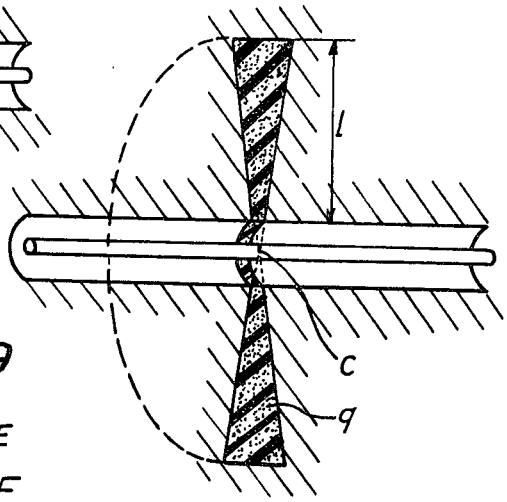
FIG. 6 shows a conical attenuator in accordance with the present invention.

The novelty of the present invention resides in the fact that there is utilized, as a radial attenuation line, not the one shown in FIG. 5, but a radial line having a conical shape as shown on FIG. 6. If the summits of the cones of the surfaces delimiting this radial line coincide with the center C of the coaxial line this line is homogenous; that is to say its characteristic impedance is independent of location and frequency. For this reason $\Delta Z\sqrt{\epsilon_r}$ and the attenuation $\alpha$ are constants independent of the frequency. The dimension 1 in FIG. 6 or in FIG. 7 must, for its part, be selected large enough that when the frequency is $f\mu$ the reaction of the edge of the short-circuited metallic disc f as shown for example in FIG. 7, remains negligibly small.

Figure 7:
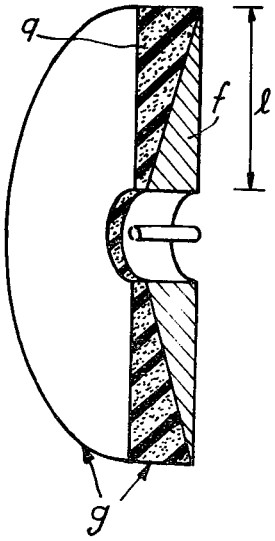
FIG. 7 shows a modified form of attenuator according to the invention.

Considerations of manufacture have led to an absorption member such as shown on FIG. 7. It comprises an absorption member q and a conical complementary metallic ring f. The two cemented parts form a flat disc E having a central hole, for example, for 5 mm of its thickness, and provides an attenuation of 0.5 decibels. The exterior surfaces g are metallized to obtain definite conductive surfaces.

There is obtained, for example, by joining 20 similar discs to each other the following electrical specifications:

Attenuation A: 10 decibels

Average uncertainty of attenuation:

$$\Delta A_m = \pm 0.2 \text{ decibels}$$

Uncertainty of attenuation on the frequency curve:

$$\Delta A_f = \pm 0.2 \text{ decibels}$$

Approximate range of frequency: 1.7–37 gigahertz (20:1)

Charging capacity (without auxiliary cooling surface): 50 watts of DC power. p1 Reflection factor: $r \leqq 0.1$ For example if one selects a coaxial line having an external conductor the diameter D of which equals 3.5 mm while the internal diameter of the conductor d=1.51 mm a cutoff wave length $$\lambda c = \pi((D+d)/2) = 7.87 \text{ mm}$$

is obtained, which results in a cutoff frequency Fc: 38 gigahertz.

The connectors actually available on the market have a cutoff frequency of 37 gigahertz. The present invention may be used over very large frequency ranges when connectors having a higher cutoff frequency become available.

Figure 8:
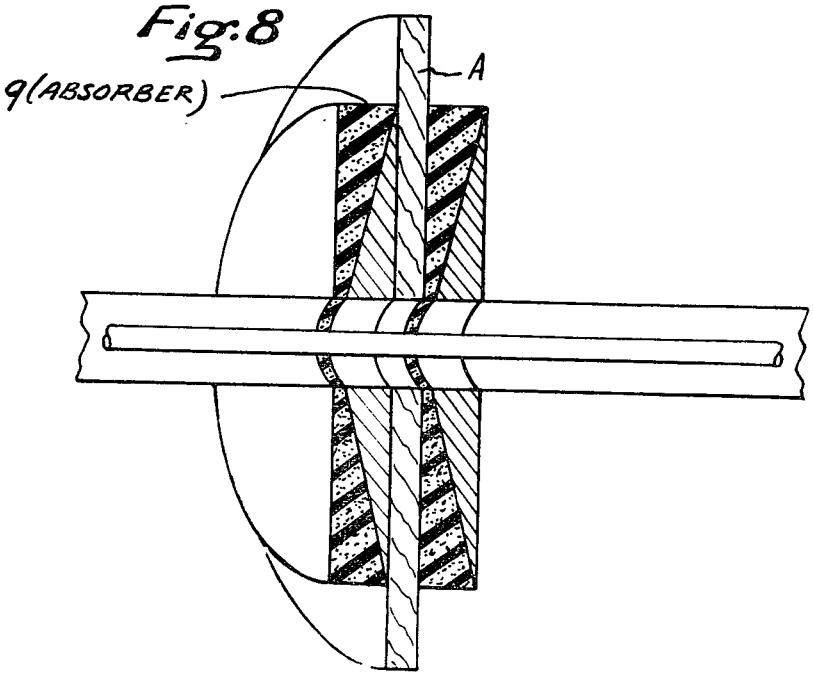
FIG. 8 shows another embodiment of the attenuator according to the invention, further having a heat dissipating fin.

FIG. 8 shows an advantageous embodiment of the attenuator according to the invention in which a fin A made of aluminum or any other material having a low thermal resistance is placed between two absorption members q such as shown on FIG. 7. This fin A may have any geometric form but must have a sufficient surface area to dissipate enough power to maintain an acceptable temperature for the attenuator. Each fin A may, for example, permit the dissipation of 50 watts at a temperature below 110° C.

Figure 9:
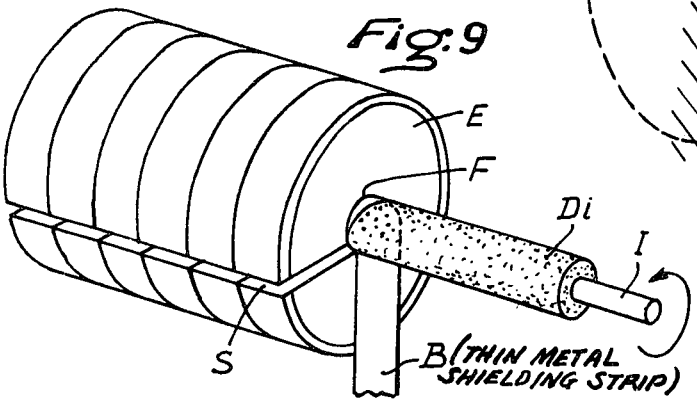
FIG. 9 shows an adjustable embodiment of an attenuator according to the invention.

An adjustable embodiment of the attenuator may, for example, be made by cutting slots S into the individual members E (as shown in FIG. 9), which slots extend tangentially outwardly from the internal surface of the outer conductor F formed by the members E. Thanks to a thin metal contact sheet B in the form of a strip capable of being wound helically by external toothed wheels (not shown) around a cellular dielectric Di, all the absorptive members E are progressively, beginning at 0 decibels (when sheet B fully covers the cellular dielectric Di), successively separated by a screen (the wound strip B) from the magnetic waves circulating in the coaxial line. In the completely screened state, when the sheet B completely covers the dielectric Di which is within members E the coaxial line consists of the strip B as an external conductor and I as an internal conductor. Sheet B can be unwound or wound through the slots S, the attenuation being 0 decibels when the sheet is fully wound, and increasing as the sheet is unwound to progressively expose more of the absorbent elements E.

The weakly absorbent cellular dielectric Di, having for example a dielectric constant of approximately 1, is advantageously made from a plurality of tubes coated with a mixture of the three components described, and threaded on the internal conductor I.

Figure 10A:
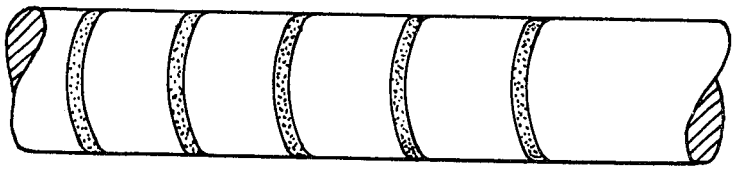
Figure 10B:
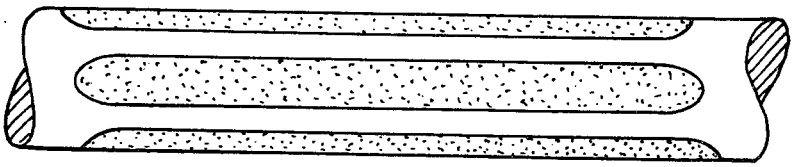

As a variation, the dielectric may be located in peripheral grooves in the inner conductor (FIG. 10*a*) or in longitudinal slots therein (FIG. 10*b*). The modified internal conductors I of FIG. 10*a* and FIG. 10*b* can be used as the internal conductors of any of the embodiments of FIGS. 6–9.

Figure 11:
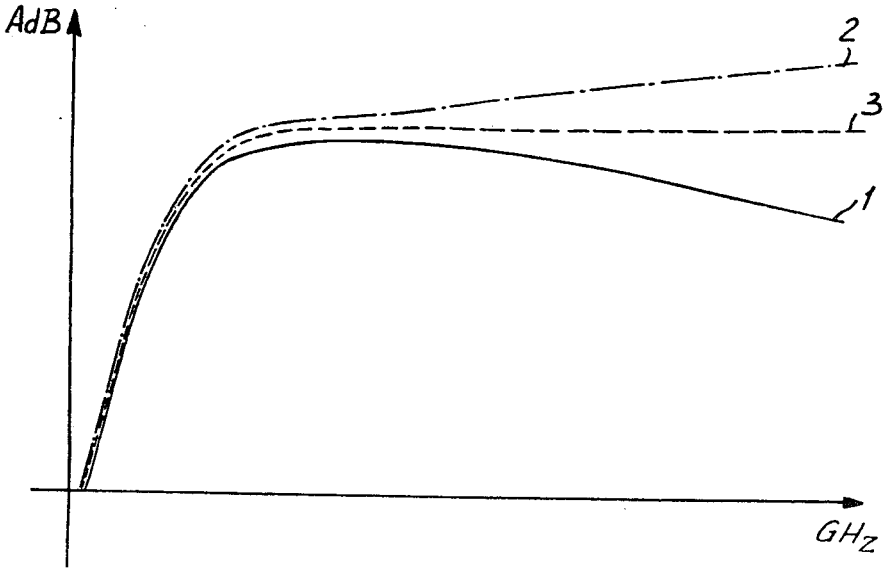

FIG. 11 shows the attenuation as a function of frequency. Curve 1 represents the attenuation without the weakly absorbent dielectric (Embodiments of FIGS. 6, 7, 8); the curve 2, the attenuation provided with this dielectric (Embodiments of FIGS. 6, 7, 8 with the inner conductor I of FIGS. 10*a* and 10*b*); the curve 3 the attenuation provided with this dielectric after screening (embodiment of FIG. 9). It will be seen that, beginning at a predetermined frequency, the attenuation becomes independent of the frequency.

The electrical specifications of this embodiment of adjustable attenuator are the same as those for the fixed embodiment except with respect to the range of attenuation which is about 0–30 decibels.

In accordance with another embodiment (not illustrated) the attenuator comprises a device (not shown) for covering or uncovering an adjustable number of absorption discs made of a straight coaxial telescopic line of the trombone type.

The high maximum load afforded by the new method of construction results from the fact that, contrary to known attenuators, the attenuating layers are positioned in the outer conductor. The high resistance to thermal variation of the solid absorption discs makes it possible to release the microwave energy withdrawn and transformed into heat directly into the atmosphere. An evaluation of the heat flow shows that the greatest thermal resistance appears at the transition point between the external surface of the outer conductor and the ambient air. From this point the absorption of power received by the attenuator depends principally on the nature of the cooling surfaces and on the temperature at which they have been received. Experiments with a prototype provided with smooth metallic surfaces serving as a transition point with the ambient air have produced an attenuator having an admissible loading capacity of 50 watts direct power for 10 decibels and 10 centimeters of attenuator length and an external surface temperature ≦ than 100° C. (ambient temperature 20° C.). With a cooling body having optimum dimensions one may obtain for the same attenuation and the same length of construction an admissible load of at least 100 watts continuous power.

What is claimed is:

1. Wide-band coaxial microwave attenuator which comprises a coaxial line element provided at its ends with coaxial leads, having a smooth inner metallic conductor and an outer conductor composed of conical radial line members similar to each other and opening outwardly, said conical members being made of a material subject to dielectric losses at a relative ratio which is constant as to permeability, constant dielectrically, and independent of frequency, said line members being grouped in a compact attenuator by complementary metallic conical rings between the sides of said line members, and said line members being adapted to be assembled to form a regular row connected in series to form a voltage divider having a selective value of attenuation.

2. Coaxial wide-band microwave attenuator as claimed in claim 1 in which the dielectric used comprises three materials, one of which is magnetic, another non-magnetic and the third a moldable resin, said attenuator also comprising a weakly absorbent dielectric which assures that the attenuation curve which, without this dielectric, would decrease slightly as the frequency increases, is practically independent of the frequency.

3. Attenuator as claimed in claim 2 in which the weakly absorbent dielectric is in the form of an elongated body positioned in the space between the inner conductor and the outer conductor.

4. Attenuator as claimed in claim 2 in which the weakly absorbent dielectric is positioned in peripheral grooves in the inner conductor.

5. Attenuator as claimed in claim 2 in which the weakly absorbent dielectric is positioned in longitudinal slots in the inner conductor.

6. Adjustable wide-band microwave attenuator according to claim 1 in which the line members comprise individual absorption discs having a slot extending tangentially outward from the internal wall of the outer conductor, a contact sheet in the form of a strip passing through the slot and wound on a cellular body in the space between the inner and the outer conductors, said sheet screening said absorption discs from the magnetic waves between the sheet and the inner conductor to provide zero attenuation when the sheet is fully wound, and unwinding said sheet through said slot progressively exposing said absorption discs to the electromagnetic waves to increase attenuation.

* * * * *